US006453861B1

(12) United States Patent
Nomura et al.

(10) Patent No.: US 6,453,861 B1
(45) Date of Patent: Sep. 24, 2002

(54) VALVE GEAR OF INTERNAL COMBUSTION ENGINE

(75) Inventors: Akifumi Nomura; Yasuo Shimura; Kazuhisa Takemoto; Akira Tokito, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/974,873

(22) Filed: Oct. 12, 2001

(30) Foreign Application Priority Data

Oct. 13, 2000 (JP) ..... 2000-314086

(51) Int. Cl.[7] ..... F01L 1/26; F01L 1/18; F01L 1/04

(52) U.S. Cl. ..... 123/90.23; 123/90.27; 123/90.34; 123/90.4; 123/90.42

(58) Field of Search ..... 123/90.22, 90.23, 123/90.27, 90.34, 90.39, 90.4, 90.42, 90.6

(56) References Cited

U.S. PATENT DOCUMENTS 4,773,361 A * 9/1988 Toki et al. ..... 123/90.23
4,913,104 A * 4/1990 Mills ..... 123/90.4
4,969,426 A * 11/1990 Fujii et al. ..... 123/90.23
5,398,649 A * 3/1995 Shimamoto ..... 123/90.23
6,293,238 B1 * 9/2001 Harmon ..... 123/90.16

FOREIGN PATENT DOCUMENTS

JP 5133207 5/1993

* cited by examiner

*Primary Examiner*—Weilun Lo
(74) *Attorney, Agent, or Firm*—Birch, Stewart, Kolasch & Birch, LLP

(57) ABSTRACT

In an internal combustion engine, a pair of suction ports are formed on left and right sides of the rear of the cylinder head with respect to the vehicle body. A pair of exhaust ports is formed on left and right sides on the front side of the cylinder head. Suction poppet valves and exhaust poppet valves for opening and closing the suction ports and the exhaust ports are slidably fitted in guide tubes, respectively. In addition, a valve gear includes a camshaft and a rocker arm pivotally supported on a rocker arm shaft. The rocker arm is formed with a bifurcated end, which crosses an ignition plug on the exhaust poppet valve side. The suction poppet valves are directly driven to open and close by the camshaft.

20 Claims, 4 Drawing Sheets

VALVE GEAR OF INTERNAL COMBUSTION ENGINE

CROSS-REFERENCES TO RELATED APPLICATIONS

The present invention claims the benefit of Japanese Patent Application No. 2000-314086, filed Oct. 13, 2000, the entirety of which is hereby incorporated by reference.

BACKGROUND OF THE INVENTION

1. Field of the Invention

The present invention relates to a valve gear for an internal combustion engine, wherein one side of the engine includes at least two poppet valves. The valve gear includes a rocker arm having a bifurcated end for driving the at least two poppet valves.

2. Description of Background Art

A conventional valve gear for a 4-stroke cycle internal combustion engine is known, wherein one suction or exhaust valve is driven to open and close through a rocker arm from a camshaft. The other of the suction or exhaust valve is directly driven to open and close from the camshaft (Japanese Patent Application Laid-Open No. 5-133207 Publication).

In the aforementioned valve gear, three suction poppet valves and two exhaust poppet valves are disposed per cylinder. A camshaft is provided with five cam crests per cylinder corresponding 1:1 to each poppet valve. Top ends of the three suction poppet valves are placed in contact with three cam crests of the camshaft to be directly driven to open and close by the cam crests. The other two exhaust poppet valves are driven to open and close by two cam crests of the camshaft through respective rocker arms. Therefore, many cam crests are necessary, two rocker arms are necessary to avoid the ignition plug, the number of parts increases, and the construction becomes complex. Accordingly, there is a disadvantage in terms of productivity and costs.

SUMMARY OF THE INVENTION

The present invention relates to an improvement in a valve gear of an internal combustion engine, which overcomes the above drawbacks. In an internal combustion engine, at least one side of the engine includes not less than two poppet valves. A valve gear includes a rocker arm formed with a bifurcated end which crosses an ignition plug on the valve side having not less than two poppet valves. The other valve is directly driven to open and close from a camshaft.

With the above construction according to the present invention, with regard to the poppet valves on the side driven to open and close by the rocker arm, one cam crest is sufficient and one rocker arm is sufficient. Furthermore, the number of assembling steps is reduced, the valve gear is decreased in weight, the construction is simplified, the productivity is enhanced considerably, and lower cost is achieved.

Furthermore, since the rocker arm is bifurcated or branched into the shape of a U to avoid the ignition plug, a nipping angle between one poppet valve and the other poppet valve is small, a combustion chamber enabling higher compression and higher combustion efficiency is easily constructed, and the performance of the internal combustion engine is materially enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

One embodiment of the present invention will now be described with reference to FIGS. 1 to 4.

Figure 1:
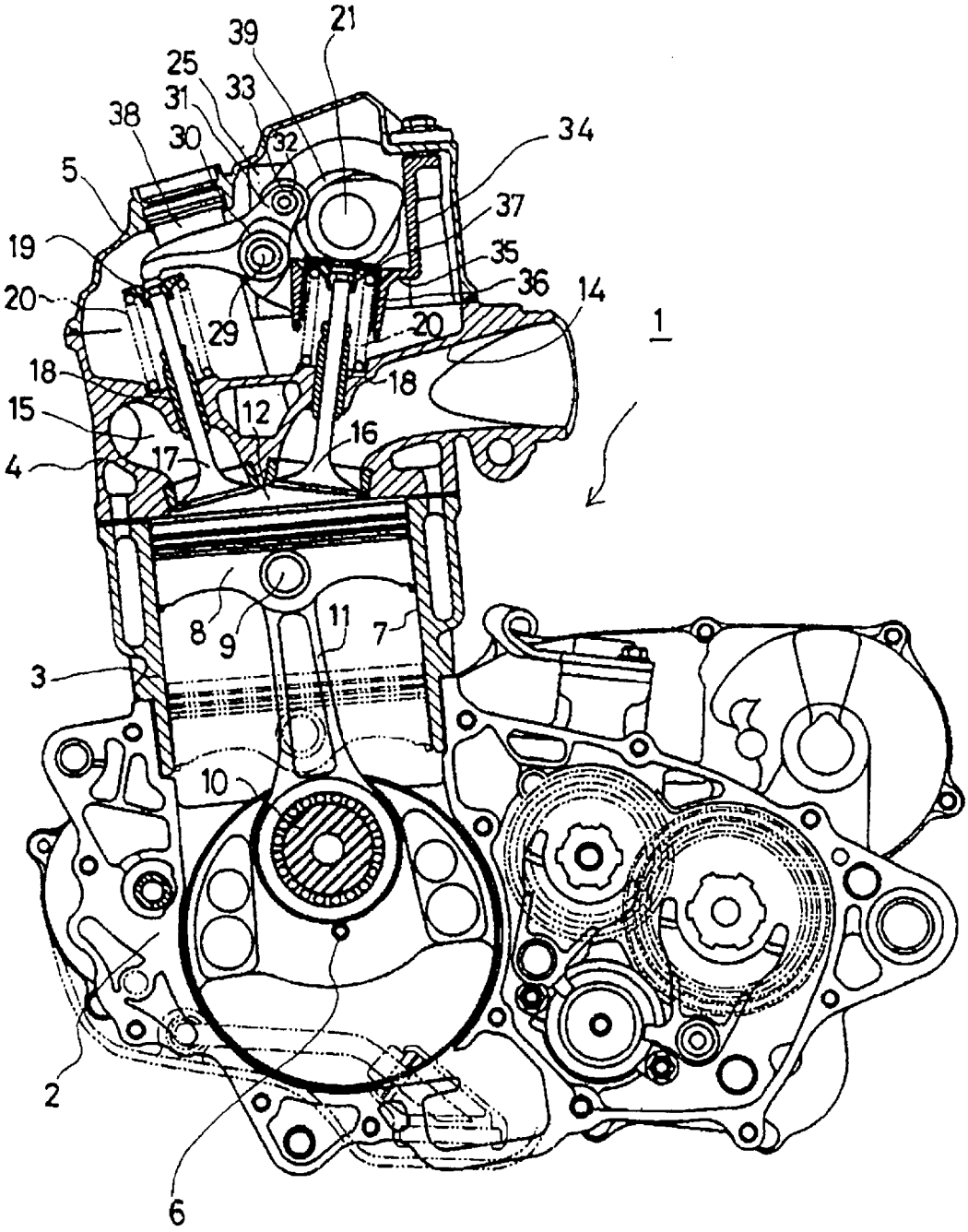
FIG. 1 is a longitudinal sectional side view of an internal combustion engine provided with a valve gear according to the present invention.

In a water-cooled overhead valve spark ignition type single cylinder 4-stroke internal combustion engine 1, a crankshaft 6 is mounted on a motorcycle (not shown) so as to be directed in a width direction of the motorcycle. A cylinder block 3, a cylinder head 4 and a cylinder head cover 5 are sequentially placed on a crankcase 2 as shown in FIG. 1. The crankcase 2, the cylinder block 3, the cylinder head 4 and the cylinder head cover 5 are connected integrally with one another by means of bolts or the like (not shown) extending therethrough.

The crankshaft 6 is pivotally supported on the crankcase 2. A piston 8 is vertically slidably fitted in a cylinder bore 7 of the cylinder block 3. The ends of a connecting rod 11 are pivotally mounted on a piston pin 9 of the piston 8 and a crank pin 10 of the crankshaft 6, respectively. The piston 8 is pressed downward by combustion gases ignited intermittently by an ignition plug 13 (see FIG. 3) in the vicinity of a top dead center of the piston 8 within a combustion chamber 12 defined by a generally triangular (in section) depressed surface in the central part of the lower surface of the cylinder head 4, the cylinder bore 7 and the top surface of the piston 8. The crankshaft 6 is driven in rotation by the pressing force.

A pair of left and right suction or intake ports 14 are formed on the rear side (right side in FIG. 1) of the vehicle body of the cylinder head 4. A pair of left and right exhaust ports 15 are formed on the front side (left side in FIG. 1) of the vehicle body of the cylinder head 4. A suction poppet valve 16 and an exhaust poppet valve 17 for opening and closing openings of the suction port 14 and the exhaust port 15 are slidably fitted in a guide tube 18 at a small valve nipping angle. Valve springs 20 are disposed between lifters 37 (on the side of the suction poppet valve 16) and retainers 19 (on the side of the exhaust poppet valve 17) provided on the top ends of the suction poppet valve 16 and the exhaust poppet valve 17, and the top surface of the cylinder head 4. The suction poppet valve 16 and the exhaust poppet valve 17 are always closed by the spring force of the valve springs 20.

Figure 2:
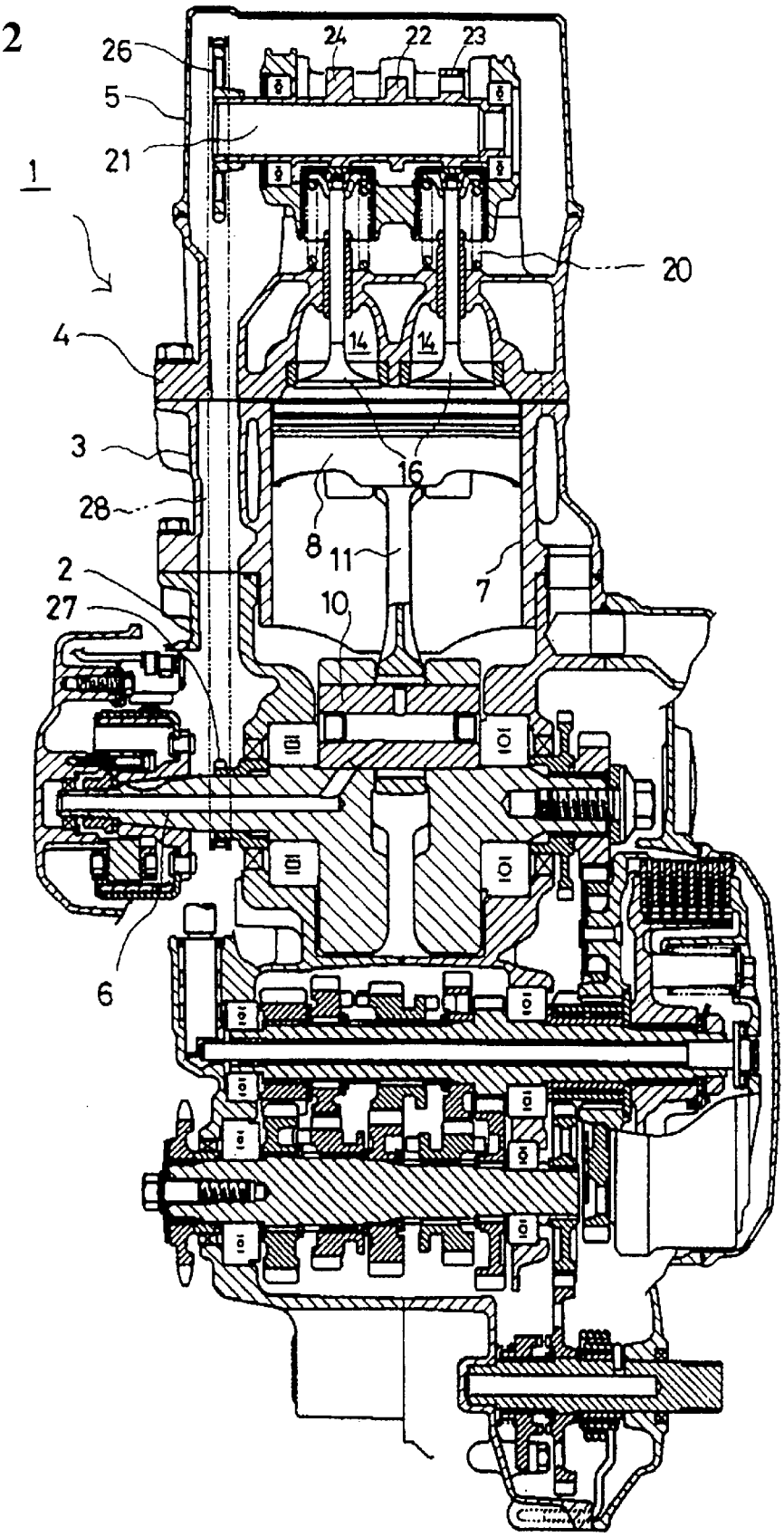
FIG. 2 is a longitudinal sectional front view of the internal combustion engine shown in FIG. 1.
Figure 3:
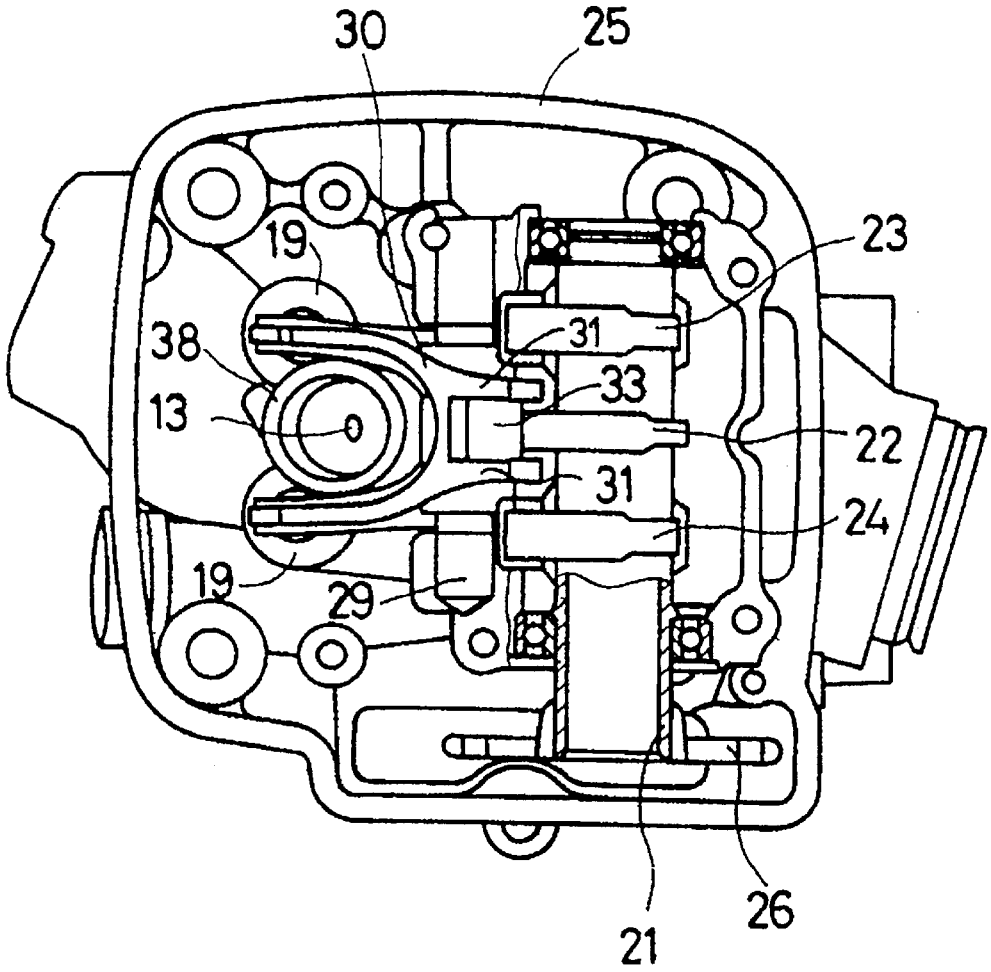
FIG. 3 is a top view of the internal combustion engine with a cylinder head cover removed.
Figure 4:
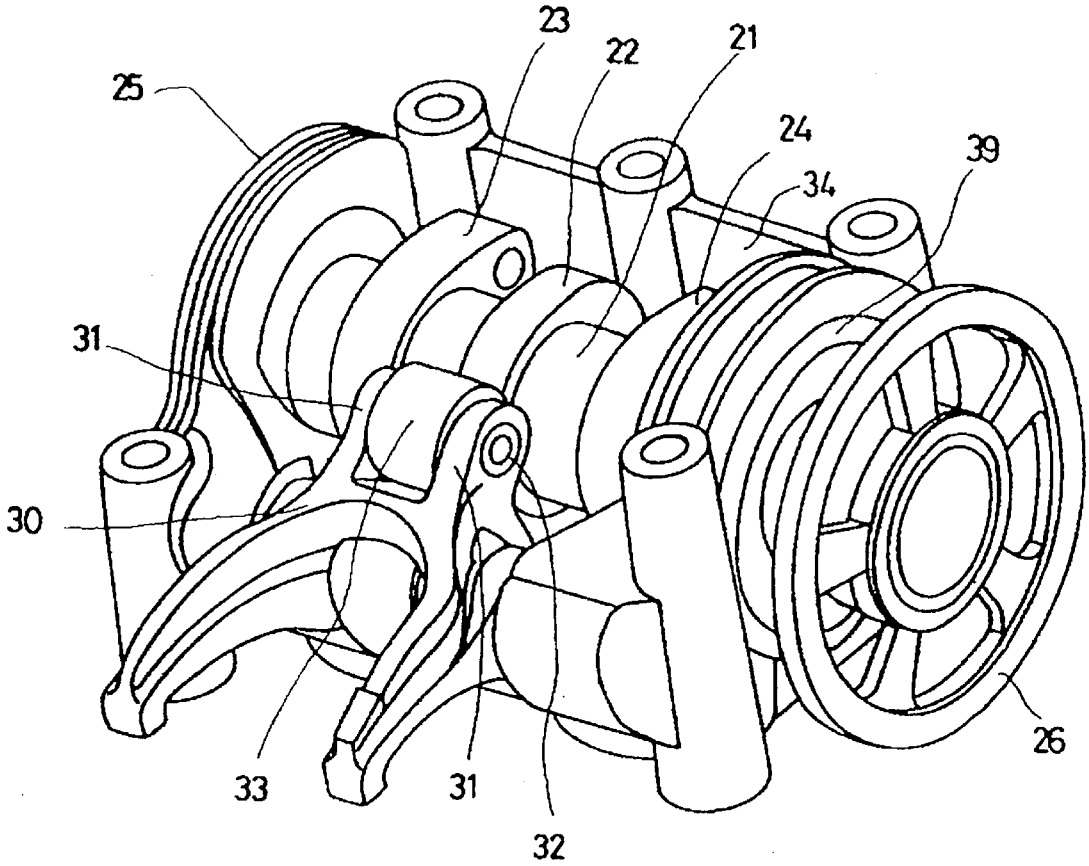
FIG. 4 is an enlarged perspective view of main parts of the valve gear.

Furthermore, as shown in FIG. 2, a diecast camshaft holder 25 pivotally supports the camshaft 21 through a rolling bearing 39 so that the camshaft 21 is parallel with the crankshaft 6. The camshaft holder 25 is mounted integrally with the cylinder head 4 by bolts (not shown). The camshaft holder 25 has a plane shape formed in the general shape of a U. A drive sprocket 26 is fitted integrally on the left end of the camshaft 21 (See FIG. 1). An endless cam chain 28 extends between a drive sprocket 27 fitted on the left side of the crankshaft 6 and the drive sprocket 26. The number of teeth of the drive sprocket 27 and the drive sprocket 26 is set to 2:1. Accordingly, when the crankshaft 6 is rotated, the camshaft 21 is rotated at a rotational speed of ½.

One mounting hole of the camshaft holder 25 with respect to the cylinder head 4 serves as an oil passage. Lubricating oil is discharged towards the cam crests 22, 23 and 24 of the camshaft 21 from the oil passage formed in the camshaft holder 25.

As shown in FIG. 1, a rocker arm shaft 29 is positioned downwardly on a front side of the vehicle body (left side) with respect to the camshaft 21. The rocker arm shaft 29 is fitted in the camshaft holder 25. Furthermore, the rocker arm shaft 29 is partly stopped by bolts to prevent the rocker arm shaft from slipping out and interfering with bolts (not shown) for mounting the camshaft holder 25 to the cylinder head 4. A rocker arm 30 is pivotally supported on the rocker arm shaft 29. A roller 33 is supported rotatably through a shaft 32 on a pair of left and right brackets 31 on one end (vehicle body rear side) of the rocker arm 30. The other end of the rocker arm 30 is branched or bifurcated toward left and right sides to form a U-shape. The bifurcated ends are respectively placed in contact with the top end of the two exhaust poppet valves 17 positioned forward of the vehicle body (left side in FIG. 1). Furthermore, a roller 33 on one end of the rocker arm 30 is placed in contact with the cam crest 22 in the central part of the camshaft 21 at a forward position with respect to the vehicle body.

As shown in FIG. 1, a bottom part 35 is formed to extend obliquely, forwardly and upwardly from the lower end of a wall part 34 at the rear of the body of the camshaft holder 25. The bottom part 35 is formed with a tube part 36 which is capable of loosely receiving a lifter 37 of the suction poppet valve 16.

The cam crests 23 and 24 positioned on left and right sides of the body of the central cam crest 22 are placed in contact with the top end of two suction poppet valve 16 positioned at the rear (right side in FIG. 1) of the body through the lifter 37. The cam crests 22, 23 and 24 of the camshaft 21 are respectively formed in a fixed shape so as to impart suction and exhaust characteristics to the suction poppet valve 16 and the exhaust poppet valve 17, which are adapted to the fixed operating circumstances of the water-cooled overhead valve spark ignition type single cylinder 4-stroke internal combustion engine 1.

Furthermore, as shown in FIG. 1, an ignition plug guide tube 38 is formed integrally with the cylinder head 4 positioned in the approximately central position of the suction poppet valve 16 and the exhaust poppet valve 17 as viewed from the side. The ignition plug guide tube 38 is somewhat inclined forwardly. The ignition plug 13 is detachably mounted on the lower end of the ignition plug guide tube 38. It is noted that the ignition plug guide tube 38 may be integrally pressed into the cylinder head 4 or may be integrally cast into the cylinder head 4.

In the embodiments shown in FIGS. 1 to 4, as mentioned above, the suction poppet valve 16 has a large diameter and weight and is directly driven to be opened and closed by the cam crests 23 and 24 of the camshaft 21. The exhaust poppet valve 17 has a light weight and is indirectly driven to be opened and closed by the cam crests 22 through the rocker arm 30. Therefore, the equivalent weight of the suction system and exhaust system is uniform, and the valve operating and closing characteristics in the high-speed rotational region is excellent.

Furthermore, a single camshaft 21 is used, and the rocker arm 30 is bifurcated or branched into the shape of a Uto avoid the wall part 34 in which the ignition plug 13 is enveloped. Therefore, a nipping angle between the suction poppet valve 16 and the exhaust poppet valve 17 is set at a small value. As a result, a combustion chamber that has a high compression ratio, and a high combustion efficiency is easily constructed to obtain a high performance water-cooled overhead valve spark ignition type single cylinder 4-stroke internal combustion engine 1.

Furthermore, one camshaft 21 is sufficient, the single camshaft holder 25 pivotally supports the camshaft 21 and the rocker arm shaft 29, and two exhaust poppet valves 17 are driven to open and close by the single rocker arm 30. Therefore, the number of parts is materially reduced, the construction is simplified, and the cost and weight are considerably reduced.

Furthermore, as shown in FIG. 1, the camshaft holder 25 is formed with the wall part 34 at the rear thereof. The bottom part 35 is somewhat inclined forwardly and upwardly and is formed at the lower edge of the bottom part 34. Therefore, the comers of the wall part 34 and the bottom part 35 serve as a lubricating oil reservoir for lubricating the contact part between the cam crest 22 and the lifter 37 sufficiently.

In addition, the lifter 37 for the suction poppet valve 16 is in contact with the cam crests 23 and 24, and the position of the roller 33 of the rocker arm 30 for the exhaust poppet valve 17 is in contact with the cam crest 22. Accordingly, the lifter 37 and the roller 33 are shifted away from each other by approximately 90° about the center axis of the camshaft 21. The opening timing of the suction poppet valve 16 and the exhaust poppet valve 17 is separated by 180° of a rotational angle of the crankshaft 6 and by 90° of a rotational angle of the camshaft 21. In view of this, the cam crests of the cam crest 22 and the cam crests 23 and 24 are at approximately the same phase angle.

Furthermore, the direction of the opening reaction of the suction poppet valve 16 and the direction of the opening reaction of the exhaust poppet valve 17 are different from each other by approximately 90°. Therefore, a large valve opening reaction is not exerted on the camshaft 21. Accordingly, a large rigidity of the camshaft 21 is not required, the weight is reduced, and higher speeds are possible.

Furthermore, since the roller 33 is pivotally supported on one end of the rocker arm 30, the rotational friction force of the camshaft 21 is reduced, and the cam crest 22 experiences less friction.

Furthermore, since the camshaft 21 is fitted in the camshaft holder 25 through the rolling bearing 39, which is larger in diameter than the cam crests 22, 23 and 24 of the camshaft 21, the camshaft 21 can be mounted from the side of the camshaft holder 25 to considerably enhance the mounting properties.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve gear for an internal combustion engine, the engine including at least two valves on one side thereof and at least one valve on an opposite side thereof, said valve gear comprising:

a rocker arm, said rocker arm being formed with a bifurcated end for avoiding an ignition plug of the engine, said bifurcated end being located on said one side for driving the at least two valves; and a camshaft, said camshaft for directly driving the at least one valve on the opposite side of the engine.

2. The valve gear according to claim 1, further comprising:

a camshaft holder, said camshaft being fitted in said camshaft holder; and a rocker arm shaft, said rocker arm being pivotally supported on said rocker arm shaft.

3. The valve gear according to claim 1, wherein said bifurcated end of said rocker arm is contactable with top ends of each of the at least two valves.

4. The valve gear according to claim 1, wherein said rocker arm further comprises:

a pair of brackets on left and right sides thereof; and a roller, said roller being rotatably mounted between said pair of brackets.

5. The valve gear according to claim 4, wherein said camshaft further comprises left and right cam crests and a central cam crest located therebetween, said roller being in contact with said central cam crest for pivoting said rocker arm about said rocker arm shaft.

6. The valve gear according to claim 5, wherein said camshaft further comprises a mounting hole, said mounting hole serving as an oil passage for lubricating said left and right cam crests and said central cam crest.

7. The valve gear according to claim 2, wherein said bifurcated end of said rocker arm is contactable with top ends of each of the at least two valves.

8. The valve gear according to claim 2, wherein said rocker arm further comprises:

a pair of brackets on left and right sides thereof; and a roller, said roller being rotatably mounted between said pair of brackets.

9. The valve gear according to claim 8, wherein said camshaft further comprises left and right cam crests and a central cam crest located therebetween, said roller being in contact with said central cam crest for pivoting said rocker arm about said rocker arm shaft.

10. The valve gear according to claim 9, wherein said camshaft further comprises a mounting hole, said mounting hole serving as an oil passage for lubricating said left and right cam crests and said central cam crest.

11. An internal combustion engine, comprising:

at least two exhaust or suction ports formed on one side thereof and at least one exhaust or suction port formed on an opposite side thereof;

at least two valves on said one side thereof for opening and closing said at least two exhaust or suction ports and at least one valve on said opposite side thereof for opening and closing said at least one exhaust or suction port;

an ignition plug; and a valve gear, said valve gear comprising:

a rocker arm, said rocker arm being formed with a bifurcated end for avoiding said ignition plug, said bifurcated end being located on said one side for driving said at least two valves; and a camshaft, said camshaft for directly driving said at least one valve on said opposite side.

12. The engine according to claim 11, further comprising:

a camshaft holder, said camshaft being fitted in said camshaft holder; and a rocker arm shaft, said rocker arm being pivotally supported on said rocker arm shaft.

13. The engine according to claim 11, wherein said bifurcated end of said rocker arm is contactable with top ends of each of said at least two valves.

14. The engine according to claim 11, wherein said rocker arm further comprises:

a pair of brackets on left and right sides thereof; and a roller, said roller being rotatably mounted between said pair of brackets.

15. The engine according to claim 14, wherein said camshaft further comprises left and right cam crests and a central cam crest located therebetween, said roller being in contact with said central cam crest for pivoting said rocker arm about said rocker arm shaft.

16. The engine according to claim 15, wherein said camshaft further comprises a mounting hole, said mounting hole serving as an oil passage for lubricating said left and right cam crests and said central cam crest.

17. The engine according to claim 12, wherein said bifurcated end of said rocker arm is contactable with top ends of each of said at least two valves.

18. The engine according to claim 12, wherein said rocker arm further comprises:

a pair of brackets on left and right sides thereof; and a roller, said roller being rotatably mounted between said pair of brackets.

19. The engine according to claim 18, wherein said camshaft further comprises left and right cam crests and a central cam crest located therebetween, said roller being in contact with said central cam crest for pivoting said rocker arm about said rocker arm shaft.

20. The engine according to claim 19, wherein said camshaft further comprises a mounting hole, said mounting hole serving as an oil passage for lubricating said left and right cam crests and said central cam crest.

* * * * *